United States Patent [19]

Smith

[11] Patent Number: 4,531,672

[45] Date of Patent: Jul. 30, 1985

[54] SOLENOID OPERATED UNIT INJECTOR HAVING DISTINCT TIMING, METERING AND INJECTION PERIODS

[75] Inventor: Edward D. Smith, Greensburg, Ind.

[73] Assignee: Cummins Engine Company, Inc., Columbus, Ind.

[21] Appl. No.: 494,434

[22] Filed: May 13, 1983

[51] Int. Cl.[3] ..... F02M 47/02

[52] U.S. Cl. ..... 239/89; 239/95; 123/446

[58] Field of Search ..... 239/88, 90, 91, 95, 239/89; 123/446, 502

[56] References Cited

U.S. PATENT DOCUMENTS

| | | | |
|---|---|---|---|
| 3,029,737 | 4/1962 | Bessiere | 417/386 |
| 3,465,737 | 9/1969 | Dreisin | 123/502 |
| 3,709,639 | 1/1973 | Suda et al. | 417/493 |
| 4,129,253 | 12/1978 | Bader, Jr. et al. | 239/88 |
| 4,235,374 | 11/1980 | Walter et al. | 239/90 |
| 4,281,792 | 8/1981 | Sisson et al. | 239/90 X |
| 4,327,693 | 5/1982 | Busser | 123/490 |
| 4,378,774 | 4/1983 | Kato | 239/88 |
| 4,402,456 | 9/1983 | Schneider | 239/90 |
| 4,418,867 | 12/1983 | Sisson | 239/88 |

*Primary Examiner*—Jeffrey V. Nase
*Assistant Examiner*—James R. Moon, Jr.
*Attorney, Agent, or Firm*—Sixbey, Friedman & Leedom

[57] ABSTRACT

A cam-operated, electronically controlled, unit fuel injector (2) including an injector body (4) containing a fluid timing circuit (20) and a fluid metering circuit (22) communicating with an injector cavity (14) within which is mounted a reciprocating plunger (16,76,78) operated by an injector cam (12) which causes the plunger (16,76,78) to experience first and second dwells during each injector cycle wherein fluid may flow in the timing circuit (20) but may not flow in the metering circuit (22) during the first dwell and may flow in the metering circuit (22) but may not flow in the timing circuit (20) during the second dwell and wherein a solenoid valve (44) is opened during the first dwell to control timing and is closed during the second dwell to control metering. Injector plunger (16) includes an inner plunger section (76) and an outer plunger section (78) mounted for independent reciprocal movement within the injector cavity (14) to define an injector chamber (80) adjacent the inner end of the injector cavity (14) and a variable volume timing chamber (90) between the inner and outer plunger sections. The timing chamber is filled with fuel during the first dwell to subsequent form a hydraulic link of variable effective length dependent upon the time of solenoid valve opening during the first dwell.

21 Claims, 6 Drawing Figures

(INJECTING)

(FUEL METERING)

(TIMING)

SOLENOID OPERATED UNIT INJECTOR HAVING DISTINCT TIMING, METERING AND INJECTION PERIODS

DESCRIPTION

1. Technical Field

The subject invention relates to a cam-operated, electronically controlled, unit fuel injector which is capable of varying the quantity and timing of each successive fuel pulse in response to a control signal which may be generated by a computer in response to changing engine conditions.

2. Background Art

Fuel injection systems for piston-type, internal combustion engines, particularly for compression ignition engines, often employ unit injectors which are each characterized by a separate cam-operated pump physically connected with an injector nozzle. By driving each cam in close synchronism with the reciprocating movement of each piston, the associated pump may be caused to operate at precisely the same time during each full movement cycle of the corresponding engine piston. Unfortunately, as engine operating conditions vary, the time during each cycle of piston movement when it is most desirable to inject fuel does not remain the same. Moreover, some emission control standards are often difficult or impossible to meet unless both timing and quantity of fuel can be controlled exactly on a cycle by cycle basis depending on operator demand and engine conditions.

Control over timing and metering is most easily achieved in fuel systems employing distributor pumps, that is where a single fuel pump is used for all the engine injectors. The distributor pump operates to supply fuel at high pressure through separate lines leading to each remote injector nozzle. However, injection systems employing distributor pumps suffer from the interfering effects caused by high pressure waves which are inherently transmitted through the high pressure lines connecting the distributor pump with the individual injectors. Accordingly, distributor pump systems, even when designed to provide variable control over timing and metering, can not achieve the high degree of accuracy necessary to meet the demand for an efficient, yet emission controlled internal combustion engine.

Although numerous attempts have been made to design a unit injector system which provides for variable timing and metering, while avoiding the inherent deficiencies of the distributor pump system, a fuel system which is both economical and highly accurate has not yet been achieved. For example, the patent to Bessiere (U.S. Pat. No. 3,029,737) discloses a cam-operated unit injector in which both the timing and quantity of fuel may be hydraulically controlled. The Bessiere injector includes a two part, cam-operated plunger wherein the plunger sections are separated by a hydraulic link whose effective length may be varied to control injector timing. However, the Bessiere design does not permit full range variability in the length of the hydraulic link from one cycle to the next. Accordingly, very quick variations in the metering and timing characteristics are difficult to achieve with this type of injector design.

One approach for solving the lack of cycle by cycle control capability is to employ a solenoid valve in combination with the unit injector to vary the quantity and timing of injection during each cycle. For example, in U.S. Pat. No. 4,129,253 to Bader et al, an electromagnetic unit fuel injector is disclosed including a single, cam-operated, injector plunger and a solenoid operated valve for determining the beginning and ending of injection and thus the timing and quantity of fuel injected during each cycle of plunger movement. Similar types of solenoid controlled unit injectors are disclosed in U.S. Pat. No. 4,129,253 to Bader et al and U.S. Pat. No. 3,709,639 to Suda et al.

Electromechanical control of unit injectors provides important advantages, not the least of which is the possibility of using computer generated control signals. However, solenoid operated injectors of the type known up to the present have been very costly to manufacture. A large component of this manufacturing cost is due to the solenoid operated valve itself which must operate reliably at high speed over an extremely long operating life involving many millions of open-close operating cycles. Previously known unit injector designs have often accentuated the operating demand on the solenoid valve by requiring the valve to operate against high injection pressure (for example, around 15,000 psi which is normally required to obtain proper fuel burning characteristics). Strong electromagnetic forces developed in a very short time are required when the valve must move against such high pressures. Electromagnets capable of building a sufficiently strong magnetic field are expensive to manufacture and require sophisticated driver circuitry capable of developing a strong initial current without building up an excessive current level. An example of the complexity of such a circuit is demonstrated in U.S. Pat. No. 4,327,693.

In an attempt to relieve some of the high performance requirements of the prior art, solenoid operated unit injectors employing hydraulically controlled timing have been developed as disclosed in U.S. Pat. Nos. 4,281,792 to Sisson et al and 4,235,374 to Walter et al. The unit injector designs disclosed in these patents include a two-part plunger having a variable volume hydraulic chamber separating the plunger sections and a single solenoid valve which commences the injection on the downstroke of the plunger by closing to form a hydraulic link between the plunger sections. On the upstroke, the solenoid valve opens at a selected point to control the quantity of fuel metered for injection on the subsequent downstroke. While this type of injector design eliminates some of the stringent requirements imposed on the solenoid valve of an electromagnetically controlled unit fuel injector, the valve is still subjected to very high pressure, in the range of 15,000 psi, during the injection period of operation and must close at a selected time during the downstroke period in order to control the injection timing. Because the downstroke must occur over a relatively short time space within the total cycle time of the engine piston, operating requirements for the solenoid and its associated driver circuitry remain high even for known unit injectors which have been, in part, designed to reduce such requirements.

DISCLOSURE OF THE INVENTION

It is a basic object of this invention to overcome the deficiencies of the prior art by providing a unit injector including an injector body containing a fluid timing circuit for controlling injector timing and a fluid metering circuit for controlling injector metering and further including a plunger means mounted for reciprocal movement within the injector body for establishing during each reciprocal movement a timing period during which fluid may flow in the timing circuit but may not flow in the metering circuit and for establishing a metering period, distinct from the timing period, during which fluid may flow in the metering circuit but may not flow in the timing circuit and still further including a valve means for controlling the injector timing by controlling the flow of fluid through the fluid timing circuit during each timing period established by the plunger means and for controlling injector metering by controlling the flow of fluid through the fluid metering circuit during each metering period established by the plunger means.

A still further object of this invention is to provide a solenoid operated, unit injector wherein the valve means operates independently of the movement of the plunger means and includes a single valve element movable between an open position in which fluid may flow in the metering circuit during the metering period and in the timing circuit during the timing period and a closed position in which the fluid flow is shut off in both the metering and timing circuits during the timing and metering period.

Another object of this invention is to provide a solenoid operated, unit injector including plunger means having an outer plunger section and an inner plunger section separated by a variable volume timing chamber into which timing fluid flows during the timing period and wherein the inner plunger section also forms a variable volume injector chamber into which fuel is metered during the metering period during a time distinct from the flow of timing fluid into the timing chamber. The timing fluid, which may be fuel, in the timing chamber forms a hydraulic link between the inner and outer plunger sections whereby the timing of fuel injection may be controlled by the effective length of the hydraulic link formed during the timing period.

A still further object of this invention is to provide a solenoid operated, unit injector in which the variable volume timing chamber is completely collapsed during each reciprocal movement of the plunger means. The injector body is provided with a drain circuit into which the contents of the variable timing chamber is dumped as the plunger means approaches its innermost position. The drain circuit contains a restrictive orifice for causing high pressures to develop in the timing chamber whereby the inner plunger section is held in its innermost position upon termination of fuel injection.

Yet another object of this invention is to provide a solenoid operated, unit fuel injector for use with an internal combustion engine having a cylinder containing a reciprocating piston, and further including an injector actuating train for operating the fuel injector in synchronism with the reciprocal motion of the piston to cause the fuel injector to inject fuel into the cylinder, wherein the injector actuating train includes an injector cam having a cam profile shaped to cause the outer plunger section to move in a reciprocal path including a timing dwell during which the outer plunger section is held in a first axial position and further including a metering dwell during which the outer plunger section is held in a second axial position. The outer plunger section is adapted to open the timing circuit during the timing dwell while holding the metering circuit closed and is adapted to open the metering circuit while closing the timing circuit during the metering dwell.

Still another object of this invention is to provide a solenoid operated, fuel injector including an injector body containing a fuel supply circuit within which a valve element is positioned for control by the injector solenoid whereby the valve element is moved from its closed to its open position during the timing period to control injector timing and is moved from its open position to its closed position during the metering period to control the amount of fuel metered into the injector chamber for subsequent injection by the unit injector.

Still other and more specific objects of this invention may be appreciated from a consideration of the drawings and description of the preferred embodiment.

BEST MODE FOR CARRYING OUT THE INVENTION

Figure 1:
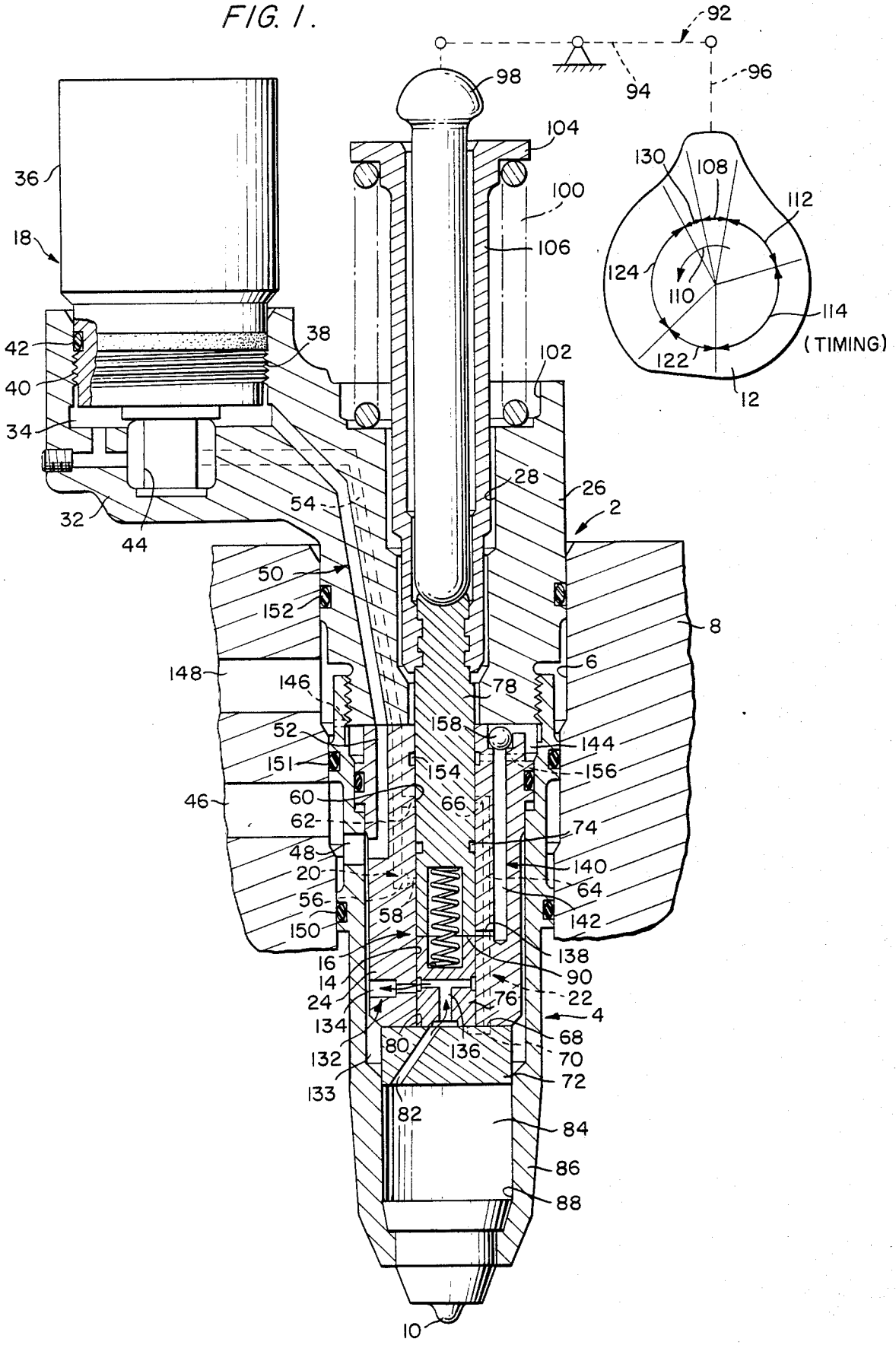
FIG. 1 is a cross-sectional view of a solenoid operated, unit injector designed in accordance with the subject invention as the injector would appear at the end of an injection period.

For a better understanding of the subject invention, reference is made to FIG. 1 in which one specific embodiment of a unit injector 2 designed in accordance with this invention is disclosed. In particular, unit injector 2 includes an injector body 4, formed as a multi-part structure, the exterior of which is adapted to be placed within an injector receiving cavity 6 formed in an internal combustion engine. The injector receiving cavity 6 is normally formed in the engine head 8 (only partially shown) such that the inner end of the injector containing the injector nozzle 10 is able to communicate with the engine cylinder into which fuel is to be injected.

The unit injector 2 of FIG. 1 is mechanically operated by an injector cam 12 which may be mounted on the same cam shaft as the engine valve cams and is rotated in synchronism with the crankshaft of the engine. By this arrangement, the injector cam may be relied upon as a reference which accurately indicates the position of the engine piston (not illustrated) mounted for reciprocal movement in the cylinder with which the injector nozzle 10 communicates. The injector cam imparts reciprocal movement to plunger means 16 mounted within injector cavity 14. As will be described in greater detail below, the plunger means 16 operates to allow fuel to be metered into the lower end of the injector cavity 14 and to cause the metered fuel to be injected through the injector nozzle 10. The plunger means 16 also operates to establish during each of its reciprocal movements a timing period and a separate metering period during which variations in the amount of fuel injected and the exact timing of the fuel injection may be controlled by a valve means 18.

Metering and timing of fuel injection is controlled by the provision of a fluid timing circuit 20 and a fluid metering circuit 22 contained within the injector body 4 wherein each of the circuits communicates with the injector cavity 14 as will be described further below. Plunger means 16 operates to establish during each reciprocal movement a timing period during which fluid may flow in the timing circuit but may not flow in the metering circuit. Similarly, the plunger means 16 operates during each reciprocal movement to establish a metering period, distinct from the timing period, during which fluid may flow in the metering circuit but may not flow in the timing circuit. Valve means 18 controls the injector timing during each injector cycle by controlling the flow of fluid through the fluid timing circuit during each timing period established by plunger means 16. Similarly, valve means 18 controls injector metering during each cycle by controlling the flow of fluid through the fluid metering circuit 22 during each metering period.

Even though the pressure of fuel being injected by the unit injector 2 of FIG. 1 may reach very high levels, in the order of 15,000 psi, the valve means 18 is never called upon to operate against such high pressure levels and is not required to operate during the relatively short downstroke or inward movement of plunger means 16 caused by the injector cam 12. For purposes of this description, movement of the injector components in a direction toward the point of injection will be referred to as "inward" or "downward" and movement away from the point of injection will be referred to as "outward" or "upward".

Before describing in detail the cyclic operation of the subject unit injector 2, reference will be made to the specific structural organization of the unit injector 2 as illustrated in FIG. 1. In particular, the injector body 4 includes an inner barrel 24 containing the injector cavity 14 oriented generally along the central longitudinal axis of the inner barrel 24. Positioned outwardly from inner barrel 24 is outer barrel 26 which contains an enlarged central cavity 28 aligned generally with injector cavity 14 for receiving the upper end of the plunger means 16. One portion of the outer barrel 26 defines a valve housing 32 containing a valve cavity 34. One end of the valve cavity 34 is opened to receive a solenoid operator 36 having external threads 38 for engaging internal threads 40 contained on the interior surface of the valve cavity 34 to allow the solenoid operator to be secured within the valve cavity 34. Valve cavity 34 is sealed by means of an 0-ring 42 as illustrated in FIG. 1. Solenoid operator 36 is adapted to move a valve element 44 (schematically illustrated in FIG. 1) between an opened position and a closed position in response to an energizing signal received from an electronic control unit (not illustrated).

The electronic control unit is designed to sense a variety of engine conditions including operator demand, crankshaft position, engine speed, manifold pressure and air charge temperature among others. One example of the type of electronic control unit (ECU) which would be suitable for use with the subject injector is disclosed in U.S. Pat. No. 4,379,332, issued Apr. 5, 1983. Of course, the program disclosed in this application would have to be modified to account for the different control regimen required by the subject unit injector design. In particular, the ECU would be programmed to cause the solenoid operator 36 to open the valve element 44 at a predetermined point during each timing period and to keep the valve element open throughout the remainder of the timing period and through the first part of the following metering period. At a selected point in the following metering period, the ECU would be programmed to cause the valve element 44 to close in order to control the amount of fuel metered for subsequent injection. Thus, the resulting energizing signals produced by the ECU will cause the valve element 44 to open at a selected time during the timing period established by plunger means 16 in order to vary the injection timing relative to the referenced position established by injector cam 12. The ECU will cause the solenoid operator 36 to move valve element 44 to its closed position during the metering period at a predetermined time in order to vary the amount of fuel metered for subsequent injection on the next downward stroke of the plunger means as caused by the injector cam 12.

Fuel, which may serve as both the timing fluid and metering fluid, is supplied to the unit injector 2 through a fuel supply 46 formed as a passageway in engine head 8. The fuel supply is arranged to provide fuel, under relatively low pressure, e.g., 30 psi, to the unit injector through a fuel supply inlet 48 formed in the injector body 4. Fuel supplied through inlet 48 is in turn directed to the timing circuit 20 and metering circuit 22 through a fuel supply circuit 50. The first leg 52 of the fuel supply circuit 50 extends between the fuel supply inlet 48 and valve cavity 34. One portion of the first leg 52 is contained within inner barrel 24 and the second portion of the first leg 52 is contained in outer barrel 26. The second leg 54 of the fuel supply circuit 50 (shown in dashed lines) is displaced circumferentially from the first leg 52 and extends from the valve cavity 34 through outer barrel 26 into inner barrel 24. Valve cavity 34 and the valve element 44 are arranged such that when the valve element 44 is moved to its closed position, no fuel is allowed to flow from the first leg 52 into the second leg 54 of the fuel supply circuit 50. When the valve element 44 moves to its open position, fuel may freely flow from leg 52 into leg 54.

During the timing period defined by plunger means 16, fuel from the fuel supply circuit 50 may pass into the injector cavity 14 from the fuel supply circuit 50 by means of the timing circuit 20. In particular, the timing circuit 20 includes a timing passage 56 consisting of a short, radially oriented passage connected at one end to the second leg 54 of the fuel supply circuit 50 and at the other end with a timing port 58 communicating with the interior of the injector cavity 14.

The metering circuit 22 is formed within inner barrel 24 and connects at one end with the second leg 54 of the fuel supply circuit 50 and connects at the other end with the innermost end of the injector cavity 14. The metering circuit 22, shown in dashed lines, includes a metering port 60 communicating with the injector cavity 14 and with the second leg 54 of the fuel supply circuit 50 by means of a short radial passage 62. On the opposite side of injector cavity 14, a metering flow branch 64 is provided extending parallel with the longitudinal axis of the injector cavity 14. Branch 64 communicates at one end 66 with the injector cavity 14 at a point remote from the innermost end of the cavity 14 and communicates at its other end 68 with the innermost end of the injector cavity 14 through a slot 70 formed in a disc 72 which closes the lower end of the injector cavity 14 and is in contact with the inner end of inner barrel 24. Slot 70 extends radially from end 68 of the metering flow branch 64 inwardly for a distance sufficient to allow fuel to pass into the innermost end of the injector cavity 14. The outer end 66 of branch 64 is arranged generally opposite to metering port 62 and is brought into communication with metering port 62 by means of a connecting passageway 74 contained within plunger means 16.

Figure 2:
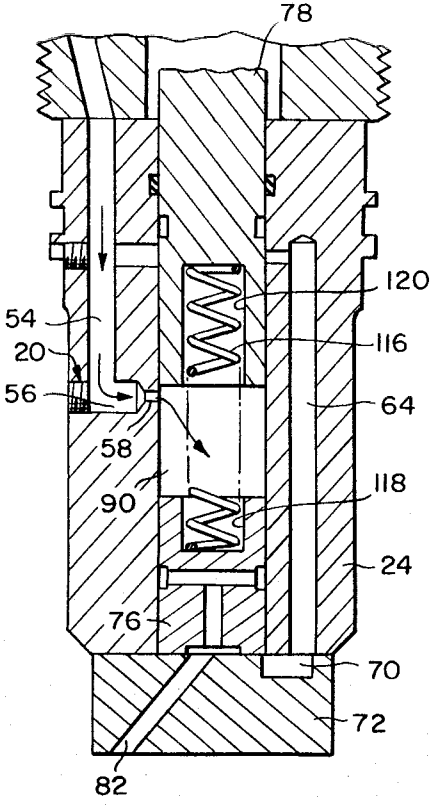
FIG. 2 is a cutaway cross-sectional view of the fuel injector illustrated in FIG. 1 during the timing period of the injector.

The plunger means 16 is formed in two parts, including an inner plunger section 76 and an outer plunger section 78, both of which are mounted for independent reciprocal movement within injector cavity 14. The space between inner plunger section 76 and disc 72 forms a variable volume injector chamber 80 illustrated in FIG. 1 in its fully collapsed position. During each cycle of injector operation, a desired quantity of fuel is metered into the variable volume injector chamber and is subsequently expelled upon inward movement of the inner plunger section 76 to cause the fuel to be expelled through injector nozzle 10. The fuel travels inwardly from the injector chamber 80 through an injection passage 82 formed in disc 72 and further inwardly through a passage (not illustrated) to the injector nozzle 10. It is convenient to provide a spring to bias the tip valve into a closed position until the pressure of the fuel supplied from the injector chamber 80 exceeds a predetermined limit after which the tip valve opens and allows fuel to be injected into the engine cylinder. A spring housing 84 is mounted below disc 72 and contains an extension of the injection passage 82 as well as the biasing spring for the tip valve. This organization of spring housing and tip valve is shown in greater detail in FIG. 2 of U.S. Pat. No. 4,281,792.

The inner barrel 24, disc 72, spring housing 84 and injector nozzle 10 are all held in abutting relationship against the bottom of outer barrel 26 by means of an injector cup 86 containing an internal cavity adapted to receive these elements in stacked configuration as illustrated in FIG. 1. The outer end of injector cup 86 contains internal threads for engaging corresponding external threads on the lower end of outer barrel 26 to permit the entire unit injector 2 to be held together by simple relative rotation of cup 86 with respect to the outer barrel 26.

The space within injector cavity 14 between the inner plunger 76 and the outer plunger section 78 forms a variable volume timing chamber 90 illustrated in FIG. 1 in its fully collapsed condition. Upon outward movement of the plunger means 16 for a distance sufficient to allow the variable volume timing chamber 90 to move to an axial position adjacent timing port 58, fuel from timing circuit 20 may flow into and expand the variable volume timing chamber 90 under the control of valve means 18. Similarly, when the plunger means 16 is moved to a position which allows the connecting passageway 74 to communicate with metering port 60 and the outer end 66 of branch 64, fuel under the control of valve means 18 may pass through the metering flow branch 64 and slot 70 into the variable volume injector chamber 80. As is stated above and described in more detail below, timing port 58 and metering port 60 are positioned axially along the injector cavity 14 such that the ports may not be opened together at any time during the reciprocal movement of the outer plunger section 78.

Injector cam 12 causes the reciprocal movement of the plunger means 16 through an injector actuating train 92 illustrated schematically in dashed lines in FIG. 1. Train 92 includes a rocker arm 94 connected at one end to the injector cam 12 through a push rod 96 and connected at the other end to the outer plunger plunger section 78 by a push tube 98. The outer plunger section 78 is biased at all times in the outward direction by means of a compression spring 100 one end of which resides in a recess 102 formed in the outer end of outer barrel 26 and the other end of which contacts radial flange 104 of a spring retainer 106. The inner end of spring retainer 106 is permanently attached to the outer end of the outer plunger section 78.

To effect the desired operation of the unit injector as illustrated in FIG. 1, the injector cam 12 is provided with a specially designed cam profile. In the position illustrated in FIG. 1, the sector 108 of the cam 12 having the greatest radial extent is in contact with push rod 96 to cause the outer plunger section 78 to assume its innermost position, thereby causing both the variable volume timing chamber 90 and the variable volume injector chamber 80 to assume a fully collapsed condition. Thus sector 108 of the cam profile may be referred to as the end of injection sector 108 since injection will terminate when this sector comes in contact with push rod 96.

Assuming that the cam 12 is rotated counterclockwise in the direction shown by arrow 110, an upstroke sector 112 will next be brought into contact with push rod 96 to cause plunger means 16 to move outwardly due to the reduced radial extent of sector 112. Continued rotation brings first dwell sector 114 into contact with push rod 96. Sector 114 has a constant radial extent to thereby hold the upper plunger section 78 in a fixed axial position which is illustrated further in FIG. 2. In this position, outer plunger section 78 uncovers timing port 58 to allow fuel supplied through second leg 54 of the fuel supply circuit 50 to enter the variable volume timing chamber 90 through timing passage 56. A light compression spring 116 is positioned within the variable timing chamber 90 to bias the plunger sections apart with a relatively weak force. The respective ends of the compression spring are received in opposed cavities 118 and 120 formed in the contacting ends of the inner and outer plunger sections 76 and 78, respectively. Because port 58 has a restricted cross sectional area, the amount of fuel which actually flows into the timing chamber 90 will depend on the pressure of the fuel in supply circuit 50 and the length of time which the valve element 44 resides in the open position. If the fuel supply pressure is held constant, the amount of fuel which flows into the timing chamber 90 will be a function solely of the time during which valve element 44 is held in its open position. The actual volume of the timing chamber 90 may expand to an amount greater than the liquid fuel volume which flows into the chamber 90 since the upper plunger section 78 is always moved upwardly to the same axial position defined by sector 114. Chamber 90 will thus be filled partially with liquid fuel and low pressure fuel vapor. The fuel vapor is returned fully to the liquid state during the subsequent full downstroke of the outer plunger section.

Figure 3:
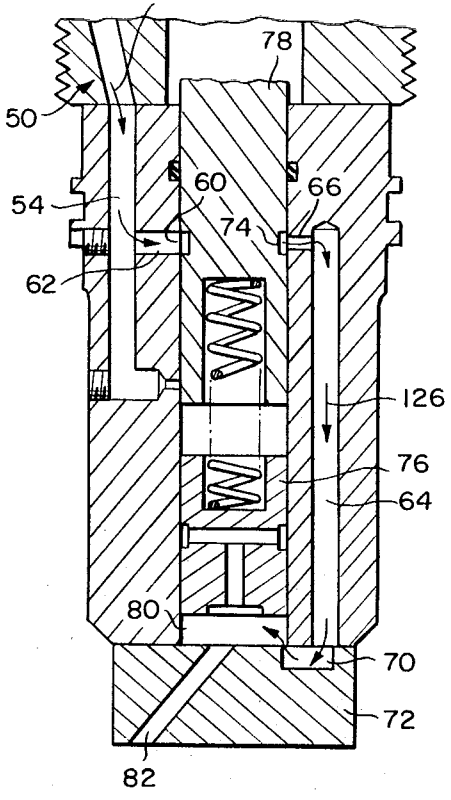
FIG. 3 is a cutaway cross-sectional view of the injector illustrated in FIG. 1 during the metering period.

As injector cam 12 continues to rotate, sector 122 which has a gradually increasing radial extent causes the outer plunger section 78 to advance inwardly by a sufficient distance to close timing port 58 and bring connecting passageway 74 into registry with metering port 60 and the outer end 66 of metering flow branch 64. Outer plunger section 78 is held in this position by the metering sector 124 of cam 12 for a period of time which defines the metering period. The resulting configuration of elements is illustrated in FIG. 3. Arrows 126 disclose the path of fuel flow through the second leg 54 of the fuel supply circuit 50 into the short radial passage 62, through the metering port 60, through the connecting passageway 74, through the metering flow branch 64, through the slot 70 and finally into the variable volume injector chamber 80. Again, flow of fuel into the injector chamber 80 may be based on pressure/-time principles by restricting the cross-section size of end 66 of branch 64 leading to injector chamber 80.

Continued rotation of the injector cam 12 completes a full injector cycle by bringing injection sector 130 into contact with push rod 96. Injection sector 130 has a sharply increasing radial extent to cause a fairly fast downstroke of the outer plunger section 78 which causes initially the metering flow branch 64 to be isolated from the fuel supply circuit 50. Additional downward movement of the outer plunger section 78 reduces the volume of the fuel/vapor trapped in the injector chamber 80 and the timing chamber 90 to cause the vapor in both chambers to revert to liquid form. A hydraulic link is formed between the inner and outer plunger sections to commence inward movement of the inner plunger section 76 to force the fuel metered into the variable volume injector chamber 80 to begin to be expelled through injection passage 82 leading to the injection nozzle 10 as illustrated by arrows in FIG. 4.

The inward movement of the inner plunger section 76 will continue until it reaches disc 72. An immediate end of injection is obtained by virtue of a pressure relief circuit 132 (illustrated in FIG. 1) which is opened just before inner plunger section 76 makes contact with disc 72. Pressure relief circuit 132 includes a pressure relief passage 134 contained in inner barrel 24 and extending radially between injector cavity 14 and the exterior surface of the inner barrel 24. The pressure relief circuit 132 further includes a pressure relief passageway 136 contained in the inner plunger section 76 extending between the variable volume injector chamber 80 and the pressure relief passage 134 when the inner plunger section reaches its innermost position. As illustrated in FIG. 1, the pressure relief passageway 136 may take the form of a radial passageway extending through the inner plunger section 76 and an axial passageway extending from the innermost face of the inner plunger section 76 toward the radial passageway.

As is further illustrated in FIG. 1, the pressure relief circuit 132 includes an annular space 133 formed between the exterior of inner barrel 24 and the interior surface of the injector cup cavity 88 to form a path of fluid communication between the pressure relief passage 134 and the fuel supply circuit 50. Obviously, the pressure relief circuit 132 could also communicate with the fuel drain 148 to provide a passage for relieving residual fuel pressure in the injector chamber at the end of each injection.

As the inner plunger section 76 reaches its innermost position, illustrated in FIG. 1, the outer end surface clears a drain port 138 which brings the timing chamber 90 into communication with a drain circuit 140 contained in the inner barrel 24. The drain circuit 140 includes a drain passage 142 extending between the drain port 138 and the upper end of the inner barrel 24. Drain port 138 is a restrictive orifice that causes high pressures to develop in the timing chamber, whereby the inner plunger 76 is held in its innermost position after fuel injection. Check valve 158 is formed in the outer end of the drain passage 142 to prevent reverse flow of fuel from the fuel drain into the timing chamber of the injector. An annular cavity 144, formed between the inner and outer barrels 24 and 26, may communicate with the exterior of the unit injector 2 through a passage such as drain aperture 146 (shown schematically in dashed lines) formed in the upper end of injector cup 86. Drain aperture 146 is positioned to communicate with fuel drain 148 contained in the engine head 8. The fuel supply and fuel drains 46 and 148, respectively, communicate with the injector receiving cavity 6 at axial locations separated by 0-ring seals 150, 151 and 152. These seals are positioned within annular grooves formed on the exterior surface of the injector body 4 at locations which insure that the fuel supplied to the injector through supply 46 is sealed from direct flow into the drain 148 between the exterior of the injector body 4 and the interior surface of the injector receiving cavity 6.

To prevent fuel leakage into the central cavity 28 of the upper barrel 26, a small radial relief groove 154 is formed on the interior surface of injector cavity 14 in the inner barrel 24. This relief groove communicates with annular drain cavity 144 through a radial leakage passage 156 (shown in dashed lines).

Figure 4:
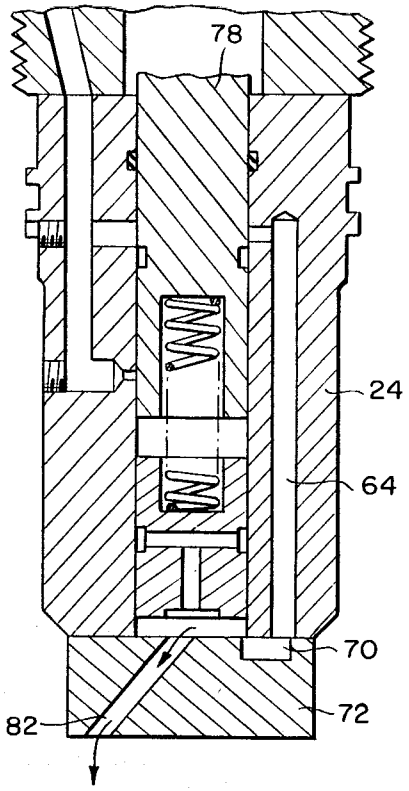
FIG. 4 is a cutaway cross-sectional view of the injector of FIG. 1 during the injection period.
Figure 5:
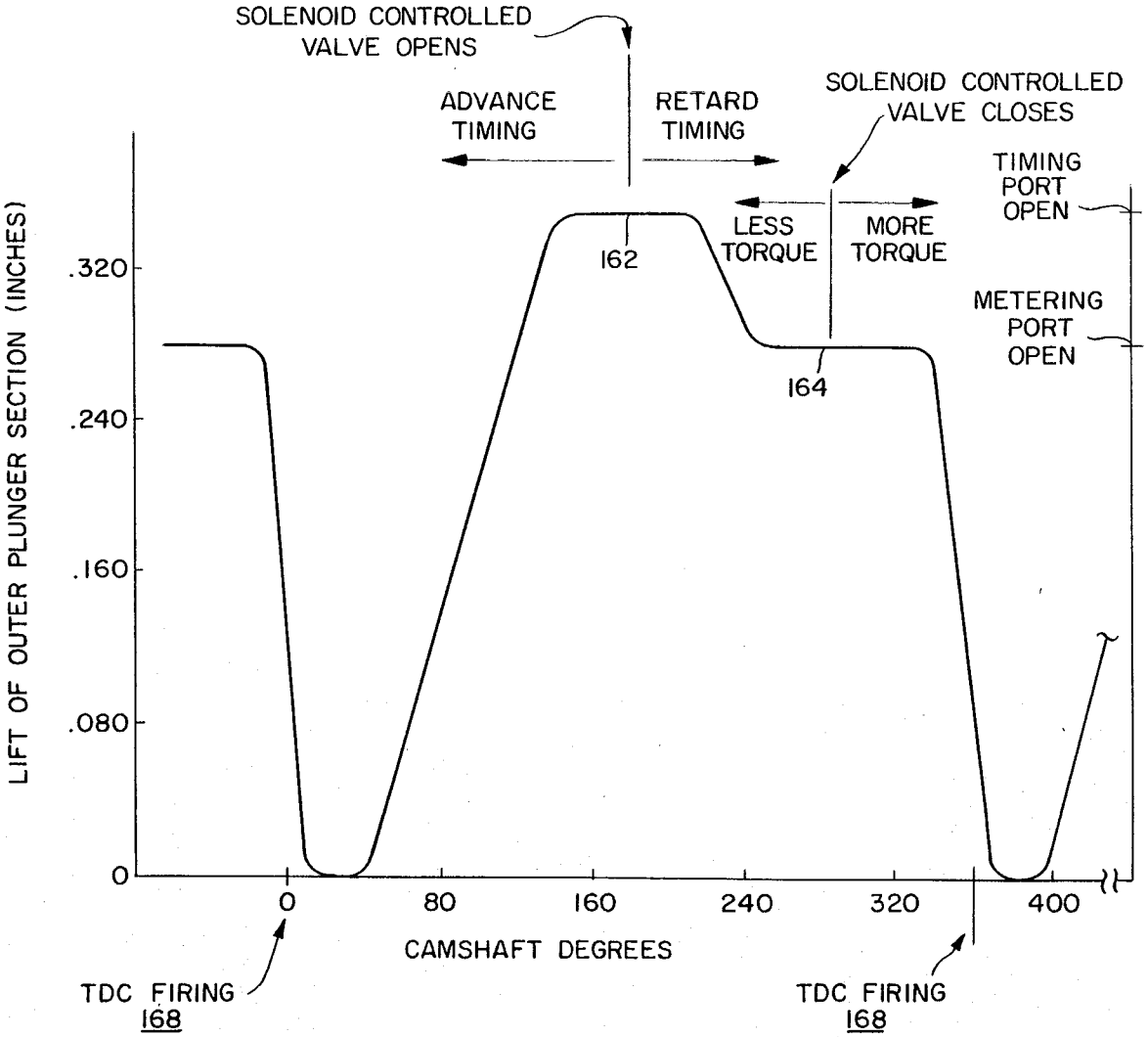
FIG. 5 is a graph illustrating the motion of the upper plunger section versus injection cam rotation throughout one complete operational cycle of the injector plunger.

Reference is now made to FIG. 5 disclosing a graph of the lift of the outer plunger section 78 versus the cam shaft rotation. It is clear from a comparison of the graph in FIG. 5 with the profile of the injector cam 12 in FIG. 1 that the outer plunger section 78 experiences dwell periods during each full cycle of injector operation corresponding to a 360° rotation of the injector cam 12. During the first dwell (represented by horizontal line 162 on the graph) the outer plunger section 78 is held in its outermost position during which the valve element 44 is initially closed until a valve opening signal is received from the electronic control unit. If the valve is opened early in the first dwell, the timing of injection will be advanced because a greater quantity of fuel will be allowed to flow into the variable volume timing chamber 90 of the injector. If the opening of valve element 44 is delayed for a greater length of time after the upper plunger section 78 reaches it outermost position, a lesser amount of fuel will flow into the timing chamber and the timing of injection will be retarded. The effective length of the timing chamber 90 and thus the total effective length of the plunger means 16 is a direct function of the point during the first dwell at which the valve element is opened. In a corresponding manner, the amount of fuel which is allowed to pass through the fuel supply circuit 50 into the injector chamber 80 is determined during the second dwell period represented by line 164. During this second dwell period, the outer plunger section 78 is held in a position allowing the fuel supply circuit 50 to communicate with the metering flow branch 64 and the injection chamber 80. In this instance, however, the valve element 44 is in its opened condition at the commencement of the second dwell period represented by line 164 to thus allow fuel to flow into the injector chamber until the electronic control unit produces a valve closing signal. If the closing signal is delayed, a greater quantity of fuel would be metered into the injector chamber whereas if the closing signal is advanced, a lesser quantity of fuel will be metered. The length of time during which the outer plunger section 78 is held in either the first or second dwell as represented by lines 162 and 164 may constitute a significantly greater portion of the total operating cycle of the injector than is represented by the relatively short period of time during each cycle when injection must take place. By transferring the control event to a longer period of the total injector cycle, the criticality in timing of the control even is reduced. Accordingly, a significant advantage of the subject design derives from the fact that the solenoid control valve is not required to move between its open and closed positions during the relatively short injection stroke of the plunger means (FIG. 4).

Figure 6:
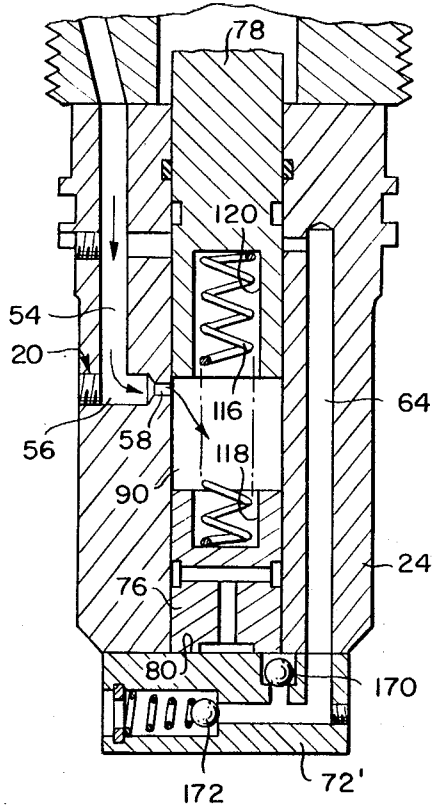
FIG. 6 is a cutaway cross-sectional view of an alternative embodiment of an injector designed in accordance with the subject invention.

Finally, reference is made to FIG. 6 wherein an alternative embodiment of the subject invention is disclosed for preventing injection pressure from entering branch 64 of the fuel metering circuit. In particular, disc 72 of the FIG. 1 embodiment has been replaced with a modified disc 72' in which a check valve means 170 is provided at the point at which branch 64 communicates with injector chamber 80 (illustrated in its fully collapsed condition). Check valve means 170 operates to permit fuel to flow readily into injector chamber 80 during the metering period but prevents reverse flow into branch 64 from the injector chamber 80. Also provided in disc 72' is a pressure relief valve means 172 which is located upstream of check valve means 170 and which is biased by spring 174 to open at a pressure above the fuel supply pressure in branch 64 but below the pressure of fuel in injector chamber 80 during the injecting period to prevent excessive pressurization of branch 64 even if check valve 170 should develop a leak.

INDUSTRIAL APPLICABILITY

The subject invention is useful in a variety of industrial applications requiring pulsed fuel injection. A particularly desirable application of the invention is for fuel injection into an internal combustion engine. The disclosed unit injector design is especially designed for compression ignition engines such as used on light to heavy duty trucks, automobiles and other vehicles. The disclosed unit injector design could also be employed in other industrial/commercial applications such as electrical generators, pump power plants and other stationary installations for internal combustion engine.

I claim:

1. A fuel injector having variable metering and timing, comprising:

(a) an injector body containing an injector cavity and including a fluid timing circuit and a fluid metering circuit communicating with the injector cavity, and further including an injector nozzle communicating with one end of the injector cavity;

(b) valve means movable between an open position wherein fluid may flow therethrough to both said fluid timing circuit and said fluid metering circuit, and a closed position wherein fluid is blocked from flowing therethrough to both of said circuits; and (c) plunger means mounted for reciprocal movement within the injector cavity, said plunger means comprising inner and outer plunger sections, a variable volume timing chamber being formed in said injector cavity between said inner and outer plunger sections and a variable volume injection chamber being formed in said injector cavity between said inner plunger section and an end of the injector cavity; wherein said plunger means is operable to be placed in a first condition establishing a timing period during which fluid may flow through said timing circuit into said timing chamber, but fluid is blocked thereby from flowing through said metering circuit into said metering chamber, is operable to be placed in a second condition establishing a metering period, distinct from said timing period, during which said flow into said timing chamber is blocked thereby and fluid may flow through said metering circuit into said metering chamber, and is operable to be placed in a third condition wherein fluid flow through both circuits to both said chambers is blocked thereby for producing injection of the fluid in said metering chamber through the injector nozzle; and wherein the valve means is operable independent of the condition of said plunger means; whereby said plunger means determines the chamber to which fluid passing through said valve means is delivered and said valve means is operable to control the amount of fluid delivered to the chamber determined by the condition of the plunger means.

2. A fuel injector as defined in claim 1, wherein said valve means includes a single valve element movable between an open position in which fluid may flow in said metering circuit during said metering period and in said timing circuit during said timing period and a closed position in which fluid flow is shut off in said circuits during said timing and metering periods.

3. A fuel injector as defined in claim 2, wherein said valve means includes a solenoid operator means for responding to an electrical signal to move said valve element between said open and closed positions.

4. A fuel injector as defined in claim 1, wherein said timing circuit includes a timing port communicating with said injector cavity and a timing passage communicating at one end with said timing port and at the other end with a source of timing fluid and wherein said metering circuit includes a metering port communicating with said injector cavity and a metering passage communicating at one end with said metering port and at the other end with a supply of fuel.

5. A fuel injector as defined in claim 4, wherein said metering circuit further includes a metering flow branch contained within said injector body, said metering flow branch communicating at one end with said injector cavity at a point remote from said injector chamber and communicating at the other end with said injector chamber, and wherein said metering circuit further includes a connecting passageway contained in said outer plunger section, said connecting passageway being positioned to permit fluid communication between said metering port and said metering flow branch during said metering period.

6. A fuel injector as defined in claim 5, wherein said outer plunger section is adapted to reside in a first axial position within said injector cavity during said timing period and is adapted to reside in a second axial position within said injector cavity during said metering period.

7. A fuel injector as defined in claim 6 for use with an internal combustion engine having a cylinder containing a reciprocating piston, further including an injector actuating train for operating the fuel injector in synchronism with the reciprocal motion of the piston to cause the fuel injector to inject fuel into the cylinder, said injector actuating train including an injector cam having a cam profile shaped to cause said outer plunger section to move in a reciprocal path including a timing dwell during which said outer plunger section is held in said first axial position and further including a metering dwell during which said outer plunger section is held in said second axial position.

8. A fuel injector as defined in claim 5, wherein said timing chamber is adapted to be collapsed during each reciprocal motion of said plunger means, and wherein said injector body contains a drain circuit for receiving fluid expelled during the collapse of said timing chamber.

9. A fuel injector as defined in claim 8, wherein said drain circuit includes a drain port communicating with said timing chamber only when said inner plunger section is adjacent its innermost position.

10. A fuel injector as defined in claim 9, wherein said drain circuit includes a drain passage and a restrictive orifice contained within said drain passage for generating high fluid pressure within said timing chamber as it is collapsing to thereby hold said inner plunger section in its innermost position.

11. A fuel injector as defined in claim 10, wherein said injector body contains a fuel supply circuit for receiving fuel under pressure and for supplying such fuel to said metering and timing circuits, said fuel supply circuit including a fuel inlet and a supply passage communicating at one end with said metering passage and said timing passage and at the other end with said fuel inlet, a valve element of said valve means being positioned in said supply passage to shut off fuel flow in said supply passage when said valve element is moved to its closed position.

12. A fuel injector as defined in claim 11, wherein said injector body further contains a pressure relief circuit communicating with said injector chamber to relieve quickly any fluid pressure within said injection chamber when said inner plunger section reaches its innermost position, thereby achieving a positive end of fuel flow through said injector nozzle.

13. A fuel injector as defined in claim 12, wherein said inner plunger section contains a pressure relief passageway communicating at one end with said injection chamber and at the other end with said pressure relief circuit.

14. A fuel injector as defined in claim 13, wherein said pressure relief circuit communicates with said fuel supply circuit.

15. A fuel injector as defined in claim 14, wherein said injector body includes (a) an inner barrel surrounding said injector chamber and said timing chamber, (b) an outer barrel positioned outwardly from said inner barrel, and (c) an injector cup containing a cavity for receiving said inner barrel and for threadedly engaging the end of said outer barrel to capture said inner barrel section within said injector cup.

16. A fuel injector as defined in claim 15, wherein said outer barrel section includes mounting means for supporting said valve means and said injector cup containing said fuel supply inlet and wherein said supply passage includes a first leg extending outwardly from said fuel supply inlet through said inner barrel and said outer barrel to said valve means and a second leg extending inwardly from said valve means through said outer barrel and said inner barrel to said metering and timing passages.

17. A fuel injector as defined in claim 1, wherein said plunger means includes a compression spring located within said timing chamber for biasing apart said inner plunger section and said outer plunger section.

18. A fuel injector as defined in claim 10, wherein said metering passage and said timing passage are oriented radially with respect to the longitudinal axis of said injector cavity and said metering flow branch and said drain passage includes substantial sections parallel with the longitudinal axis of said injector cavity.

19. A fuel injector as defined in claim 12, wherein said connecting passageway is formed by an annular radial groove formed on the exterior of said outer plunger section and wherein said pressure relief circuit includes a space formed between the exterior surface of inner plunger section and the interior surface of said injector cup cavity formed in said injector cup.

20. A fuel injector as defined in claim 5, wherein said metering circuit includes a check valve means for permitting fuel flow into said injector chamber during the metering period and for preventing fluid flow from said injector chamber into said metering circuit during the period of injector operation when the metered fuel is injected.

21. A fuel injector as defined in claim 20 wherein said metering circuit further includes a pressure relief valve means upstream of said check valve means for allowing fuel to be dumped from said metering circuit when the pressure within the metering circuit reaches a predetermined pressure above the normal fuel supply pressure.

* * * * *